US011428134B2

(12) United States Patent
Hanneke et al.

(10) Patent No.: US 11,428,134 B2
(45) Date of Patent: Aug. 30, 2022

(54) HEATING DEVICE FOR A TANK OF AN EXHAUST GAS AFTERTREATMENT SYSTEM, TANK DEVICE

(71) Applicant: Robert Bosch GmbH, Stuttgart (DE)

(72) Inventors: Juergen Hanneke, Stuttgart (DE); Ruben Schreiber, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 361 days.

(21) Appl. No.: 16/473,078

(22) PCT Filed: Oct. 12, 2017

(86) PCT No.: PCT/EP2017/076039
§ 371 (c)(1),
(2) Date: Jun. 24, 2019

(87) PCT Pub. No.: WO2018/114075
PCT Pub. Date: Jun. 28, 2018

(65) Prior Publication Data

US 2019/0353073 A1 Nov. 21, 2019

(30) Foreign Application Priority Data

Dec. 22, 2016 (DE) ..... 10 2016 226 021.9

(51) Int. Cl.
*F01N 3/20* (2006.01)
*H05B 3/78* (2006.01)

(52) U.S. Cl.
CPC ..... *F01N 3/2066* (2013.01); *H05B 3/78* (2013.01); *F01N 2610/02* (2013.01);
(Continued)

(58) Field of Classification Search
CPC ..... F01N 3/2066; F01N 2610/10; F01N 2610/02; F01N 2610/1406;
(Continued)

(56) References Cited

U.S. PATENT DOCUMENTS 2,757,079 A * 7/1956 Magee ..... C07C 47/02 75/413
4,090,668 A * 5/1978 Kochenour ..... B60S 1/481 15/250.04
(Continued)

FOREIGN PATENT DOCUMENTS

DE 102010009182 8/2011
DE 102013217927 3/2015
(Continued)

OTHER PUBLICATIONS

International Search Report for Application No. PCT/EP2017/076039 dated Dec. 18, 2017 (English Translation, 2 pages).

*Primary Examiner* — Devon C Kramer
*Assistant Examiner* — Kelsey L Stanek
(74) *Attorney, Agent, or Firm* — Michael Best & Friedrich LLP

(57) ABSTRACT

The invention relates to a heating device (6) for a tank (2) of an exhaust gas aftertreatment agent system, having a carrier (7) and having a plurality of heating elements (10) arranged on the carrier (7). According to the invention, the carrier (7) has a plurality of carrying elements (8), which are connected to one another in an articulated manner, and at least one spring element (13), which applies a spring force to at least two of the carrying elements (8). The carrier (7) is thus formed to be flexible or deformable overall, wherein the carrier is forced into a final shape by the spring element.

13 Claims, 2 Drawing Sheets

(52) U.S. Cl.
CPC .. *F01N 2610/10* (2013.01); *F01N 2610/1406* (2013.01); *F01N 2610/1486* (2013.01); *F01N 2900/1811* (2013.01); *H05B 2203/02* (2013.01); *H05B 2203/021* (2013.01)

(58) Field of Classification Search
CPC ..... F01N 2610/1486; F01N 2900/1811; H05B 2203/02; H05B 2203/021; H05B 3/78; Y02A 50/20; Y02T 10/12
USPC ..... 219/385
See application file for complete search history.

(56) References Cited

U.S. PATENT DOCUMENTS

| | | | | |
|---|---|---|---|---|
| 7,477,519 | B2 * | 1/2009 | Kubo | H01L 23/04 361/719 |
| 7,647,767 | B2 * | 1/2010 | Osaku | F01N 3/2066 60/286 |
| 2007/0157602 | A1 * | 7/2007 | Gschwind | F02M 31/125 60/274 |
| 2007/0163245 | A1 * | 7/2007 | Sheridan | F01N 3/2066 60/286 |

FOREIGN PATENT DOCUMENTS

| | | | | |
|---|---|---|---|---|
| DE | 102013217927 | A1 * | 3/2015 | F01N 3/2066 |
| DE | 102013222288 | | 5/2015 | |

* cited by examiner

HEATING DEVICE FOR A TANK OF AN EXHAUST GAS AFTERTREATMENT SYSTEM, TANK DEVICE

BACKGROUND OF THE INVENTION

The invention relates to a heating device for a tank of an exhaust gas aftertreatment system, having a carrier and having a plurality of heating elements arranged on the carrier.

Furthermore, the invention relates to a tank device for storing and providing a liquid exhaust gas aftertreatment agent for an exhaust gas aftertreatment system of an internal combustion engine, in particular a motor vehicle, having a tank and having a heating device arranged in the tank.

Heating devices and tank devices of the type mentioned at the beginning are known from the prior art. In order to reduce the pollutant content in the exhaust gas of internal combustion engines in motor vehicles, it is known to subject the exhaust gas to an exhaust gas aftertreatment. For this purpose, the exhaust gas coming from the internal combustion engine is guided, inter alia, through one or more catalytic converters. In order to bring about a particularly advantageous pollutant-reducing reaction, it is also known to add a liquid exhaust gas aftertreatment agent to the exhaust gas, said exhaust gas aftertreatment agent advantageously reacting together with the exhaust gas downstream in a catalytic converter. In particular, what is referred to as the SCR method (SCR=selective catalytic reduction) is used in many motor vehicles.

Since the exhaust gas aftertreatment agent has to be available in all seasons in order to be able to reduce the pollutant emissions at all times, it is important that the exhaust gas aftertreatment agent, which conventionally in the form of an aqueous urea solution freezes at low ambient temperatures of less than −11° C., is able to heat up and thaw. For this purpose, it is known to arrange a heating device in the tank storing the exhaust gas aftertreatment agent, which heating device can be activated in order to thaw frozen exhaust gas aftertreatment agent when required.

SUMMARY OF THE INVENTION

The heating device according to the invention has the advantage that the heat provided by the heating device for thawing frozen exhaust gas aftertreatment agent is distributed better in the tank than previously. In particular, it is ensured that even regions further away from the extraction point of the exhaust gas aftertreatment agent can be reliably thawed. Furthermore, simple installation of the heating device is ensured. According to the invention, it is provided that the carrier has a plurality of carrying elements which are connected to one another in an articulated manner, and at least one spring element which applies a spring force to at least two of the carrying elements. The carrier is therefore configured to be flexible or deformable overall, with the carrier being forced into a final shape by the spring element.

The spring element is configured/arranged to stretch the carrier such that the carrying elements are moved apart and are distributed in the tank. By means of the articulated connection, the flexible configuration of the carrier is ensured in a simple manner without the carrying elements being able to move completely freely in the tank. It can thereby be ensured that the carrier obtains a predetermined shape. Owing to the fact that the spring element applies a spring force to at least two of the carrier elements, the latter are at least forced apart when the spring element is configured as a compression spring, or pulled toward each other when the spring element is configured as a tension spring. In each case, a movement is thereby introduced into the carrier which brings about the advantageous distribution of the carrying elements.

According to a preferred development of the invention, it is provided that in each case two of the carrying elements are connected to one another by at least one spacer. The spacer ensures that the carrying elements do not exceed or fall short of a predetermined distance, and therefore a final shape of the carrier is defined by the spacers and/or an initial shape of the carrier is defined by the spacers, which simplifies installation and ensures the operation in the tank.

The respective spacer is preferably configured as a minimum spacer, and therefore a minimum distance between the carrying elements is ensured by the spacer. This has the advantage that, for example, two carrying elements do not lie too closely against each other. This is of advantage particularly whenever the two carrying elements which are connected to one another by the minimum spacer each carry a heating element.

Alternatively, it is preferably provided that the respective spacer is configured as a maximum spacer, and therefore the maximum distance which the two carrying elements can take up with respect to each other is limited by the spacer. This limits the maximum expansion of the carrier in the tank. This has an advantage with respect to the connecting lines with which, for example, the heating elements arranged on the carrying elements are in contact. By means of the maximum spacer, it is ensured that said connecting lines, for example, are not overstressed and thereby damaged. Preferably, at least one spacer is present between two of the carrying elements of the heating device. According to a further preferred development of the invention, it is provided that a spacer is correspondingly arranged in each case between in each case two carrying elements. All or some of the spacers can be configured here as minimum spacers or maximum spacers. The heating device can in particular have a combination of minimum spacers and maximum spacers which act between the carrying elements.

According to a preferred development of the invention, it is provided that the carrying elements are configured as joints of the carrier. The articulated connection is thereby ensured by the carrying elements themselves. This facilitates the production and the installation.

Furthermore, it is preferably provided that at least one of the heating elements is arranged in each case on a plurality of the carrying elements, in particular on each carrying element. This ensures that heat is advantageously distributed in the tank. In addition, the carrying elements and/or the spacers are particularly preferably configured to be heat-conductive in order to further distribute the heat generated or output by the heating elements in the tank.

According to a preferred embodiment of the invention, it is provided that at least one of the heating elements, in particular all of the heating elements, is or are configured as electric heating elements. In particular, the respective heating element is configured as a PTC or resistance heating element (PTC=positive temperature coefficient). The heating elements can each be configured as individual heating elements or as band heating elements, for example having PTC characteristics. In addition, it is also conceivable to configure one of the heating elements, in particular all of the heating elements, as liquid heating elements through which a heated liquid passes, and as heat converters which output heat carried along by the liquid into the tank.

In particular, it is provided that a plurality of heating elements are arranged on a flexible heater band, wherein the heater band is connected at a plurality of points or to a plurality of carrying elements such that the heater band is stretched in the tank by the positioning of the carrying elements. This ensures a simple arrangement of the heating elements on the carrier and in the tank itself.

According to a preferred development of the invention, it is provided that the spring element is configured as a bending spring, in particular in serpentine form in its longitudinal extent. This provides a cost-effective realization of the spring element, which ensures simple forcing apart of the carrying elements.

Alternatively, it is preferably provided that the spring element is configured as a helical spring. By this means, high spring forces can be ensured on a small construction space. It is also conceivable that the carrier has a plurality of spring elements, wherein at least one of the spring elements is configured as a helical spring and another of the spring elements as a bending spring.

Furthermore, it is preferably provided that the carrying elements themselves are configured as spring parts, in particular as helical springs. As a result, the carrying elements combine the function of carrying stature with that of the spring structure. According to a preferred embodiment, one of the carrying elements as a spring part forms the at least one spring element. Alternatively, it is preferably provided that the carrying elements, or at least one of the carrying elements, is configured as a stiff carrier part in order to form the carrier at least in sections in the manner of a coupling mechanism such that a defined movement of the carrier is achieved, and also a defined final shape which permits a secure and advantageous arrangement in the tank.

The tank device according to the invention is distinguished by the heating device according to the invention. The advantages mentioned are produced. In particular, it is provided that the tank device has an opening, the cross section of which suffices to receive the heating device in the compressed state, and therefore the heating device can be introduced into the tank in a simple manner. In the interior of the tank, the heating device can then be stretched by the spring element or the spring elements into a shape which will no longer permit passage through the opening of the tank.

BRIEF DESCRIPTION OF THE DRAWINGS

Further advantages and preferred features and combinations of features emerge in particular from what has already been described and from the claims. The invention will be explained in more detail below with reference to the drawings, in which:

DETAILED DESCRIPTION

Figure 1A:
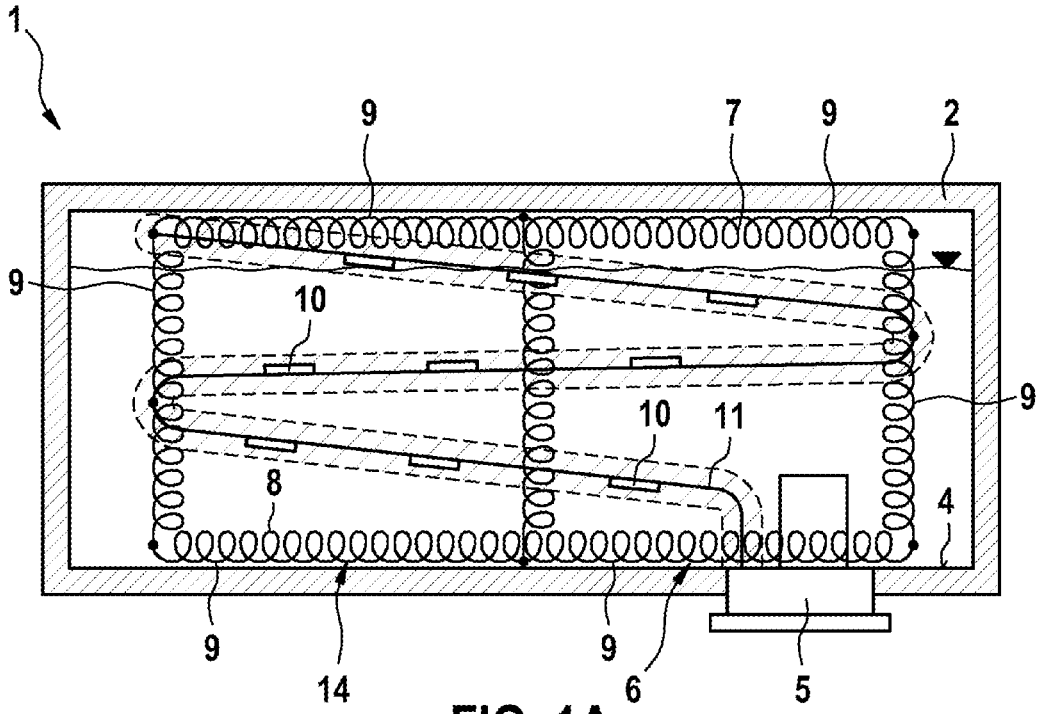
FIGS. 1A and B show a first exemplary embodiment of an advantageous tank device.
Figure 1B:
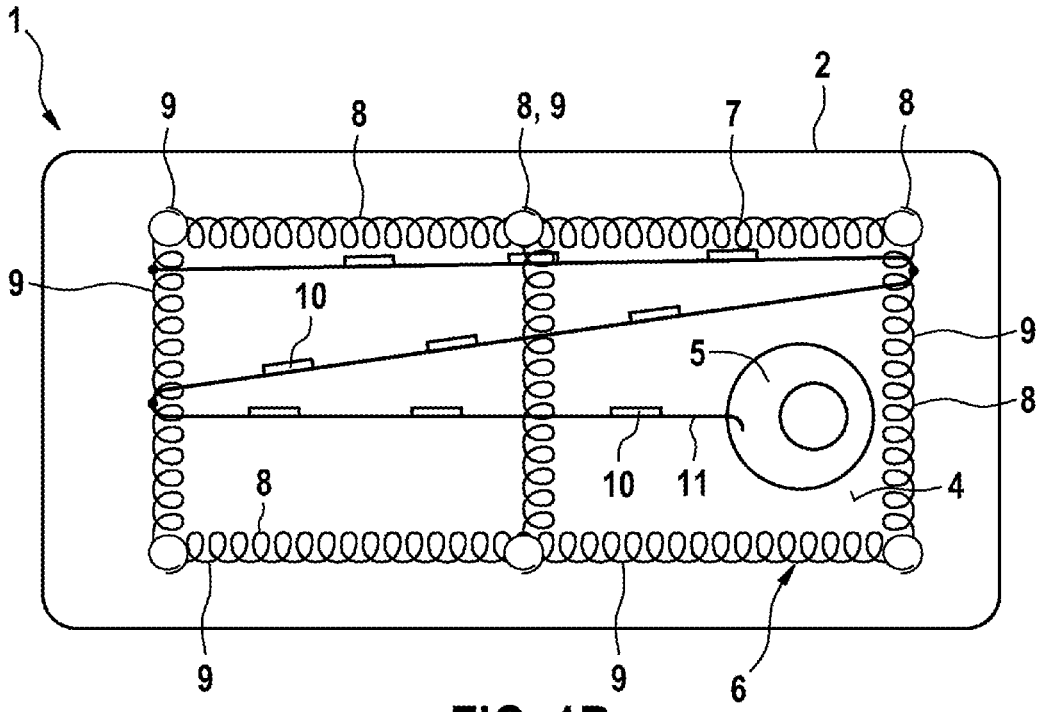

FIG. 1A of FIG. 1 shows a simplified sectional illustration of a tank device 1 of an exhaust gas aftertreatment system (not illustrated specifically here) and FIG. 1B shows a top view of the tank device 1.

The tank device 1 comprises a tank 2 in which an in particular liquid exhaust gas aftertreatment agent is stored or can be stored. A tank bottom 4 of the tank 2 is assigned an extraction module 5 by means of which the liquid exhaust gas aftertreatment agent can be extracted from the tank 2. For this purpose, the extraction module 5 in addition to an extraction opening in particular also has a conveyor device for sucking up and conveying the liquid exhaust gas aftertreatment agent.

Furthermore, a heating device 6 is arranged in the tank 2. The heating device 6 has a carrier 7 which is produced from a plurality of carrying elements 8. In the present case, the carrying elements 8 are configured as spring parts 9. The spring parts 9 are connected in an articulated manner to one another at their ends and are configured as compression springs. In addition, the carrying elements 8 are manufactured from a heat-conductive material.

A plurality of heating elements 10 which are configured as electric heating elements, in particular as resistance heating elements, are arranged on the carrier 7. The heating elements 10 are arranged here on a heater band 11 which is electrically connected to the extraction module 5. The heating element 11 is connected to the carrier 7 at a plurality of points, and therefore the heater band 11 is stretched in the tank 2 by the resilient carrying elements 8 such that an extensive heating region is produced in the tank 2, said heating region being shown here by a region indicated by dashed lines. Within the heating region, even frozen exhaust gas aftertreatment agent can always be thawed and is therefore available for the extraction module 5. Owing to the fact that the heater band 11 leads to the extraction module 5, the advantage is also achieved here that thawed exhaust gas aftertreatment agent flows directly to the extraction module 5 through the channel thawed in the frozen exhaust gas aftertreatment agent.

FIG. 1B shows the tank device 1 in a top view, from which it is apparent that the heater band 11 is preferably not only guided in a serpentine-like manner in a vertical plane, as shown in the exemplary embodiment of FIG. 1A, but optionally or preferably also runs in a serpentine-like manner in a horizontal plane in order to be able to reach and thaw an even greater volume in the tank 2.

Figure 2:
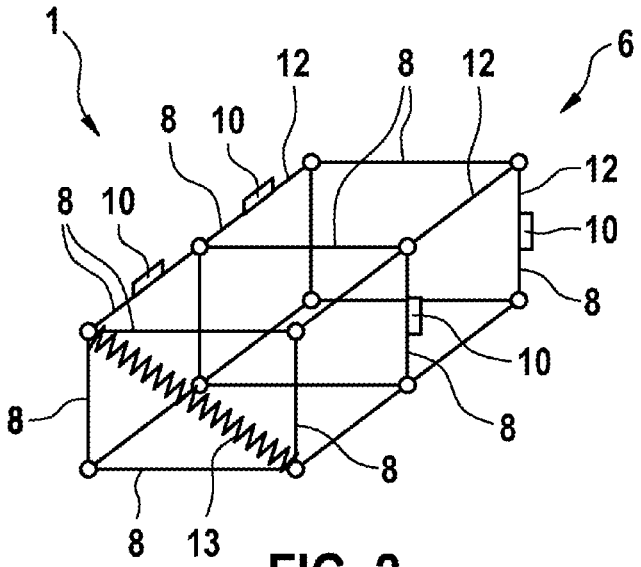
FIG. 2 shows a second exemplary embodiment of the tank device.

FIG. 2 shows a further exemplary embodiment of the tank device 1, wherein only the heating device 6 which differs from the preceding exemplary embodiment is illustrated here. FIG. 2 basically shows the design of the heating device 6 with the carrying elements 8 which are connected to one another in an articulated manner at their ends, shown in FIG. 2 by junction points, in order to form a three-dimensional structure which corresponds to a three-dimensional lattice. In the preceding exemplary embodiment, the carrying elements 8 are each configured as spring parts 9. As an alternative thereto, according to the exemplary embodiment of FIG. 2, it is provided that the carrying elements 8 are configured as rod-shaped stiff carrying parts 12. Preferably either the horizontal or the vertically oriented carrying elements 8 are configured as carrying parts 12, and the respectively remaining carrying elements 8 as spring parts 9. All of the carrying elements 8 are preferably configured as carrying parts 12 which are connected to one another in an articulated manner at their ends. In this case, at least one spring element 13 is then additionally provided which is kept pretensioned as a compression spring between at least two carrying elements 8, in particular between articulation points, in order to move the latter away from one another, as a result of which the lattice structure is erected. The effect achieved here by the provision of the carrying parts 12 is that the joints are each at a fixed distance from one another. In an embodiment with spring parts, as is shown in FIG. 1, the carrier 7 preferably has spacers 14 which define a minimum distance or a maximum distance between the carrying elements 8 in order to provide a predetermined starting shape or final shape of the carrier 7. The spacers 14 can thus be configured, for example, by the spring parts 9 themselves, in particular in the function as minimum spacers.

Furthermore, it is conceivable not to arrange the heating elements 10 on a separate heater band 11, but directly on the carrying elements 8, in particular on at least one vertically oriented and/or at least on one horizontally oriented carrying part 12. It is also conceivable to arrange the heating elements 10 directly on the joints.

Figure 3:
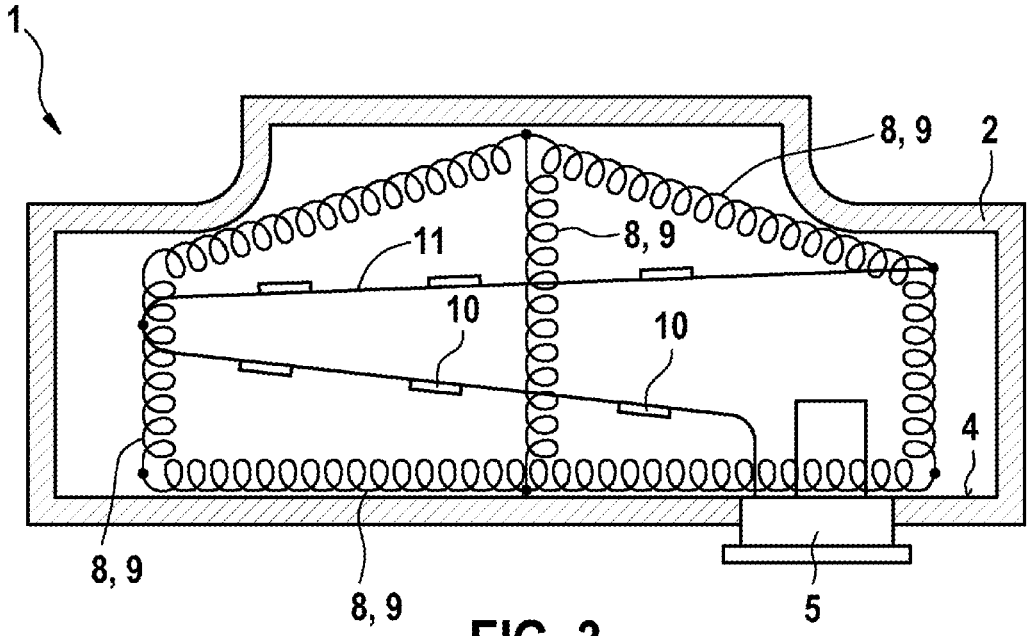
FIG. 3 shows a third exemplary embodiment of the tank device, in each case in a simplified illustration.

FIG. 3 shows a further exemplary embodiment of the tank device 1 which differs from the first exemplary embodiment in that the tank has a contour which differs from a rectangular shape. If the heating device 6 known from FIG. 1 is inserted in said tank 2, the advantage is afforded that said heating device is automatically adapted to the contour of the tank by the spring action and the flexibility of the carrier 7 and thereby ensures simple installation and a large thawing volume in the tank 2.

The effect also achieved by the advantageous configuration of the carrying elements 8 from a heat-conductive material is that, even in the regions spaced apart from the heating elements 10, heat is introduced into the possibly frozen exhaust gas aftertreatment agent. A continuous admission of heat into the entire or virtually entire tank filling is ensured, enabling the tank volume to be able to be thawed in all sloping positions of the vehicle. As an alternative to the described exemplary embodiments with electric heating elements 10, it is also conceivable to provide liquid heating elements through which a heating liquid flows in order to thaw the tank volume, in particular the exhaust gas aftertreatment agent.

The invention claimed is:

1. A heating device (6) for a tank (2) of an exhaust gas aftertreatment agent system, the heating device having a carrier (7) and having a plurality of heating elements (10) arranged on the carrier (7), characterized in that the carrier (7) has a plurality of carrying elements (8) which are separate from one another and are connected to one another in an articulated manner, and at least one spring element (9, 13) which applies a spring force to at least two of the plurality of carrying elements (8), wherein the plurality of heating elements (10) are separate from and coupled to the plurality of carrying elements (8) at a plurality of points.

2. The heating device as claimed in claim 1, characterized in that at least one of the plurality of carrying elements (8) forms a spacer (14).

3. The heating device as claimed in claim 2, characterized in that the spacer (14) defines a minimum distance between at least two of the plurality of carrying elements (8) and is configured to prevent the at least two of the plurality of carrying elements (8) from moving closer than the minimum distance.

4. The heating device as claimed in claim 2, characterized in that the spacer (14) defines a maximum distance between at least two of the plurality of carrying elements (8) and is configured to prevent the at least two of the plurality of carrying elements (8) from moving further than the maximum distance.

5. The heating device as claimed in claim 1, characterized in that at least one of the plurality of heating elements (10) is arranged on one of the plurality of the carrying elements (8).

6. The heating device as claimed in claim 1, characterized in that at least one of the plurality of heating elements (10) is configured as an electric heating element (10).

7. The heating device as claimed in claim 1, characterized in that the plurality of heating elements (10) are arranged on a heater band (11), wherein the heater band (11) is connected to the plurality of the carrying elements (8) at the plurality of points.

8. The heating device as claimed in claim 1, characterized in that the at least one spring element (14) is configured as a helical spring.

9. The heating device as claimed in claim 1, characterized in that at least one of the plurality of carrying elements (8) is configured as a stiff carrier part (12).

10. The heating device as claimed in claim 1, characterized in that at least one of the plurality of carrying elements (8) is designed as an elastically deformable spring part (9).

11. A tank device (1) for storing and providing a liquid exhaust gas aftertreatment agent for an exhaust gas aftertreatment system of an internal combustion engine, the tank device having a tank (2) and having a heating device (6) arranged in the tank (2), wherein the heating device (6) is configured as claimed in claim 1.

12. The heating device as claimed in claim 1, characterized in that at least two of the plurality of carrying elements (8) are connected to one another by at least one spacer (14).

13. The heating device as claimed in claim 1, characterized in that each of the plurality of heating elements (10) is arranged on one of the plurality of carrying elements (8).

* * * * *